US005370909A

United States Patent [19]

Tanaka et al.

[11] Patent Number: 5,370,909

[45] Date of Patent: Dec. 6, 1994

[54] LIQUID COMPOSITION AND PROCESS FOR TREATING ALUMINUM OR TIN CANS TO IMPART CORROSION RESISTANCE AND MOBILITY THERETO

[75] Inventors: Shigeo Tanaka, Yokohama; Tomoyuki Aoki, Chigasaki; Masayuki Yoshida, Yokohama; Yasuo Iino; Shinichiro Asai, both of Hiratsuka, all of Japan

[73] Assignee: Henkel Corporation, Plymouth Meeting, Pa.

[21] Appl. No.: 949,258

[22] PCT Filed: Jun. 13, 1991

[86] PCT No.: PCT/US91/04250

§ 371 Date: Dec. 18, 1992

§ 102(e) Date: Dec. 18, 1992

[30] Foreign Application Priority Data

Jun. 19, 1990 [JP] Japan ..... 2-160443
Jul. 6, 1990 [JP] Japan ..... 2-179271

[51] Int. Cl.[5] ..... B05D 1/02; C23F 11/00

[52] U.S. Cl. ..... 427/388.4; 427/421; 427/435; 252/135; 252/174.23; 252/389.2; 252/390; 252/394

[58] Field of Search ..... 427/388.4, 327, 354, 427/421, 435, 443.1; 252/135, 136, 174.23, 523, 529, 525, 389.2, 390, 394

[56] References Cited

U.S. PATENT DOCUMENTS

| | | | |
|---|---|---|---|
| 2,438,877 | 3/1948 | Spruance, Jr. | 148/6.16 |
| 4,148,670 | 4/1979 | Kelly | 148/6.15 R |
| 4,332,646 | 6/1982 | Tsurumaru et al. | 204/1 T |
| 4,433,015 | 2/1984 | Lindert | 427/388.4 |
| 4,457,790 | 7/1984 | Lindert et al. | 148/6.15 R |
| 4,859,351 | 8/1989 | Awad | 252/32.5 |
| 4,927,472 | 5/1990 | Matsushima et al. | 148/261 |
| 5,063,089 | 11/1991 | Lindert et al. | 427/354 |

FOREIGN PATENT DOCUMENTS

| | | |
|---|---|---|
| 0091166 | 10/1983 | European Pat. Off. . |
| 0312176 | 4/1989 | European Pat. Off. . |
| 0319018 | 7/1989 | European Pat. Off. . |
| 0363200 | 11/1990 | European Pat. Off. . |
| 3146265 | 2/1991 | Germany . |
| 52-131937 | 11/1977 | Japan . |
| 61-91369 | 4/1986 | Japan . |
| 6485292 | 3/1989 | Japan . |
| 1100281 | 4/1989 | Japan . |
| 1172406 | 7/1989 | Japan . |
| 2165165 | 4/1986 | United Kingdom . |
| 2180854 | 4/1987 | United Kingdom . |

*Primary Examiner*—Asok Pal
*Assistant Examiner*—P. Achutamurthy
*Attorney, Agent, or Firm*—Ernest G. Szoke; Wayne C. Jaeschke; Norvell E. Wisdom, Jr.

[57] ABSTRACT

A corrosion resistant film with a low coefficient of friction that facilitates automatic conveying can be formed on the surface of tin-plated steel or of aluminum, particularly DI cans of one of these types of metal, by contacting the aluminum or the tin plated steel with an aqueous liquid composition having a pH in the range from 2.0 to 6.5 and containing:

(A) from 1 to 30 g/L of phosphate ions, (B) from 0.1 to 10 g/L of condensed phosphate ions, and (C) from 0.1 to 20 g/L as solids of water-soluble polymers of N-vinylphenol substituted on the phenolic rings with dialkylaminomethyl groups.

20 Claims, No Drawings

LIQUID COMPOSITION AND PROCESS FOR TREATING ALUMINUM OR TIN CANS TO IMPART CORROSION RESISTANCE AND MOBILITY THERETO

TECHNICAL FIELD

The present invention relates to a novel liquid composition for treating the surface of tin-plated steel and/or aluminum and alloys that are predominantly aluminum (both the pure metal and alloys being denoted hereinafter by the word "aluminum" unless the context requires otherwise), particularly the surfaces of drawn-and-ironed (hereinafter "DI") cans made from these materials. The composition imparts an excellent corrosion resistance and paint adhesiveness to the surface of such a can after its formation by the drawing and ironing of metal sheet but before its painting or printing. This novel liquid composition also imparts the excellent mobility or slideability, i.e., low frictional resistance, which is required for the smooth conveyor transport of such a can. The composition also is relatively low in pollution potential, because it contains no deliberately introduced chromate or fluorine. The invention also relates to processes for using the composition according to the invention.

BACKGROUND ART

In the field of liquid compositions for treating the surface of tin-plated DI can of the aforementioned type, one example is the invention disclosed in (1) Japanese Patent Application Laid Open [Kokai or Unexamined] Number 01-100,281 [100,281/89]. This particular invention comprises a film-forming liquid composition for the treatment of metal surfaces in which the liquid composition has a pH of 2 to 6 and contains 1 to 50 g/L of phosphate ions, 0.2 to 20.0 g/L of oxyacid ions, 0.01 to 5.0 g/L of tin ions, and 0.01 to 5.0 g/L of condensed phosphate ion. Treatment with this conversion treatment liquid composition lays down a strongly corrosion-resistant phosphate film on the surface of a tin-plated DI can.

The inventions disclosed in (2) Japanese Patent Application Laid Open Number 01-172,406 [172,406,/89] and U. S. Pat. No. 4,457,790 are examples of a treatment method intended to develop corrosion resistance and adhesiveness through the use of water soluble resin. These inventions teach methods for treating metal surfaces with a solution which contains a derivative of a suitable polyhydric phenol compound and an aminomethylene substituted phenolic polymer or oligomer respectively.

The treatment baths previously employed to treat the surface of aluminum and aluminum alloy of the aforementioned type can be generally classified into chromate types and non-chromate types. The chromate types typically take the form of chromic acid chromate conversion treatments and phosphoric acid chromate conversion treatments. Chromic acid chromate conversion treatments entered into practical application in about 1950, and these are still widely used for heat exchanger fin material and the like. This type of conversion treatment bath is based on chromic acid ($CrO_3$) and hydrofluoric acid (HF) and also contains an accelerator. It lays down a film which contains modest quantities of hexavalent chromium.

The phosphoric acid chromate conversion treatment derives from the invention in U.S. Pat. Number 2,438,877 (1945), and this type of conversion treatment bath is based on chromic acid ($CrO_3$), phosphoric acid ($H_3PO_4$), and hydrofluoric acid (HF). It forms a film whose principal component is hydrated chromium phosphate ($CrPO_4.4H_2O$). As this film does not contain hexavalent chromium, it is currently widely employed as a paint undercoating treatment for the body and lid of beverage cans.

The invention disclosed in Japanese Patent Application Laid Open [Kokai or Unexamined] Number 52-131937 [131,937/77] is a typical prior art example within the realm of non-chromate types of treatments for aluminum. The disclosed treatment bath comprises an acidic aqueous coating solution (pH=approximately 1.0 to 4.0) which contains zirconium or titanium or a mixture thereof, as well as phosphate and fluoride. The application of this conversion treatment bath exemplary of the prior art to the surface of aluminum generates a conversion film whose principal component is zirconium oxide or titanium oxide. While the absence of hexavalent chromium is an advantage associated with non-chromate type treatment baths, the corrosion resistance and paint adherence achieved with such baths in the prior art are inferior to those with chromate type treatments. Furthermore, both the chromate type treatments and non-chromate type treatments contain fluorine, while environmental considerations have recently created demand for a fluorine-free surface treatment bath.

Within the sphere of treatment methods which use water-soluble resin in order to impart corrosion resistance and paint adherence to aluminum, the following are listed as exemplary of the prior art: Japanese Patent Application Laid Open Number 61-91369 [91,369/86] and Japanese Patent Application Laid Open Number 01-172406 [172,406/89]. In these methods, the metal surface is treated with a solution which contains a useable derivative of a polyhydric phenolic compound. However, it is difficult with these methods to form an adequately stable film on the surface of aluminum, and this precludes the appearance of a satisfactory performance (corrosion resistance).

During the metal can manufacturing process, the high friction coefficient of the exterior can surface causes the can surface to have a poor slideability during conveyor transport of the can, which causes the can to tumble ever sideways and thus impairs the transport operation. Can transportability is a particular issue with respect to transport to the printer in a high speed continuous manufacturing plant. It is therefore important in the can manufacturing industry to reduce the static friction coefficient of the exterior can surface without compromising the adhesiveness of any paint or lacquer to be coated on the can. The invention disclosed in (3) Japanese Patent Application Laid Open Number 64-85292 [85,292/89] is an example of a method for improving the slidability. This invention concerns an agent for treating the surfaces of metal cans. This particular agent contains water-soluble organic material selected from phosphate esters, alcohols, monovalent and polyvalent fatty acids, fatty acid derivatives, and mixtures of the preceding.

DESCRIPTION OF THE INVENTION

Problems to Be Solved by the Invention

The above-described invention (1) does lead to the formation of a strongly corrosion-resistant phosphate film on conventional tin-plated DI can; however, the tin-plated DI can produced over the last few years has used smaller quantities of tin plating in response to economic pressures. This has necessitated surface treatments with a far better corrosion resistance than before, and this demand is not entirely satisfied by invention (1). The other above described inventions do not always result in a satisfactorily stable corrosion resistance with the tin-plated DI can produced over the last few years or with aluminum cans. Finally, the above-described invention (3) does in fact improve the slideability, but it sometimes does not improve the corrosion resistance or paint adhesiveness to an adequate degree.

Thus, with respect to cans carrying small quantities of tin plating or aluminum cans, the prior art leaves problems unsolved with regard to the formation of a highly corrosion resistant film and with regard to improvements in the slideability and paint adhesiveness.

SUMMARY OF THE INVENTION

As a concrete means for solving the aforementioned problems which arise in the prior art, the present invention provides a liquid composition for treating the surface of tin-plated DI can, said liquid composition being characterized by a pH of 2.0 to 6.5 and containing 1 to 30 g/L of phosphate ions, 0.1 to 5 g/L of condensed phosphate ion if used on tin plated steel or 0.1 to 10 g/L of condensed phosphate ions if used on aluminum, and 0.1 to 20 g/L (as solids) of water-soluble resin with the following general formula:

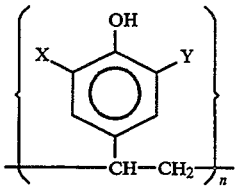

where n is an integer within the range from 10 to 80 inclusive; each of X and Y is independently selected from hydrogen or a group "Z" with the formula given below, except that at least 15% of the total of all the X and Y groups in this component of the composition are Z rather than hydrogen; and

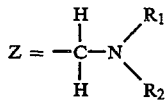

where each of $R_1$ and $R_2$ independently is a $C_1$ to $C_{10}$ alkyl and/or hydroxyalkyl group.

Application of a surface-treatment liquid composition according to the present invention provides an aluminum or a tin-plated DI can surface with an excellent corrosion resistance and paint adhesiveness prior to its painting or printing and also generates the excellent slideability necessary for smooth conveyor transport of the can. Finally, because the treatment bath according to the present invention does not contain chromium or fluorine, the waste water treatment load is substantially reduced compared to most prior treatment baths, especially for aluminum.

DETAILED OF PREFERRED EMBODIMENTS OF THE INVENTION

The surface-treatment liquid composition according to the present invention is an acidic treatment liquid composition whose essential components are phosphate ions, condensed phosphate ions, and water-soluble resin of a particular type.

The phosphate ions can be introduced into the treatment liquid composition using phosphoric acid ($H_3PO_4$), sodium phosphate ($Na_3PO_4$), and the like. Its content should fall within the range preferably of 1 to 30 g/L and more preferably of 5 to 15 g/L. At below 1 g/L, the reactivity is relatively poor and film formation generally will not be satisfactory. A good-quality film can be formed at values in excess of 30 g/L, but the cost of the treatment liquid composition is increased and the economics are therefore impaired.

The condensed phosphate ions are selected from pyrophosphate ions, tripolyphosphate ions, and tetrapolyphosphate ions. The acid or salt can be used to introduce the condensed phosphate ions. For example, when pyrophosphate ions are to be introduced, pyrophosphoric acid ($H_4P_2O_7$), sodium pyrophosphate ($Na_4P_2O_7$), and the like can be used. This component should be present at 0.1 to 5 g/L for treating tin plated steel or at 0.1 to 10 g/L for treating aluminum, and the range of 0.4 to 1 g/L for tin plate or 1.0 to 4.0 g/L for aluminum is particularly preferred. At values less than 0.1 g/L, a satisfactory film will not be formed because of weak etching activity. However, the etching activity is undesirably high at values in excess of 5 g/L on tin plate or 10 g/L on aluminum, and the film-forming reaction is inhibited.

The water-soluble resin used by the present invention comprises polymers with the general formula already given above. The molecular weight is too low at values of n in this formula below 10, so that little or no improvement in corrosion resistance will normally be observed. At values for n of 81 and above, the aqueous solution has a reduced stability, which will normally generate problems in practical applications. Functional groups $R_1$ or $R_2$ containing 11 or more carbons usually would reduce the stability of an aqueous solution containing them. The group Z is preferably $-CH_2N(CH_3)_2$ or $-CH_2N(CH_3)CH_2CH_2OH$. When less than 15% of the total of all the X's and Y's in the resin are Z, there are usually stability problems with the compositions that would otherwise be according to the invention.

The water soluble resin should be present at a concentration of from 0.1 to 20 g/L on a solids basis. At values less than 0.1 g/L, stable film formation on the can surface highly problematic. Values in excess of 20 g/L are uneconomical due to the increased cost of the treatment solution.

The pH of the treatment liquid composition must be from 2.0 to 6.5. Etching is heavy and film formation is impaired at pH values less than 2.0. At values in excess of 6.5, the liquid composition life is shortened because the resin tends to precipitate and sediment. The pH can be adjusted through the use of an acid, for example, phosphoric acid, nitric acid, hydrochloric acid, hydrofluoric acid (if waste water contamination with fluoride is not a problem), and the like, or through the use of a base, for example, sodium hydroxide, sodium carbonate, ammonium hydroxide, and the like.

When metal ions (e.g., tin, aluminum, or iron) are introduced into the treatment liquid composition, precipitation may occur due to the formation of a resin/-metal ion complex, and a chelating agent in addition to the resin as specified above should preferably be added to the treatment liquid composition in such cases. While this chelating agent is not specifically restricted, chelating agents useful within this context are exemplified by tartaric acid, ethanolamine, gluconic acid, oxalic acid, and the like.

The method for preparing the surface-treatment liquid composition according to the present invention can be briefly described as follows. Prescribed quantities of phosphate ions and condensed phosphate ions as described above are dissolved in water with thorough stirring. When the pH of this liquid composition is not already less than 7, it is adjusted to below 7 using the appropriate acid as noted above. The water-soluble resin specified by the present invention is then added and completely dissolved while stirring, and the pH is adjusted if necessary as discussed above.

The film which is formed by means of the present invention's surface-treatment liquid composition is believed to be an organic and inorganic composite film which is composed primarily of the resin and phosphate salts (the main component is believed to be tin phosphate when tin plated substrates are treated). While the invention is not limited by any theory, it is believed that the substrate is etched by the phosphate ions and condensed phosphate ions, the pH at this time is locally increased at the interface, and phosphate salt is deposited on the surface. Moreover, the amino group in the resin has a chelating activity, and it may form a type of coordination compound with the fresh surface of the substrate generated by etching. The simultaneous presence of the condensed phosphate ions is thought to promote formation of resin/metal coordination compounds, and this may make possible the stable formation of the composite film on the surface over a broad pH range.

A process according to the invention for treating tin-plated DI can using a surface-treatment liquid composition of the present invention will now be considered. The present invention's treatment liquid composition can be applied by the following process sequence, which is a preferred sequence for a process according to this invention.

1. Surface cleaning: degreasing (a weakly alkaline cleaner is typically used on tin-plated DI can, while an alkaline, acidic, or solvent based degreaser may be effectively used on aluminum cans.)
2. Tap water wash
3. Film-formation treatment (application of the treatment liquid composition according to the present invention) treatment temperature: ambient to 80° C. treatment method: spray treatment time: 2 to 60 seconds 4. Tap water wash
5. Wash with de-ionized water
6. Drying A surface-treatment liquid composition according to the present invention can conveniently be used at treatment temperatures from room temperature up to 80 ° C.; however, it is generally preferably used at 40° to 60° C. The spray time preferably should be 2 to 60 seconds. At less than 2 seconds, a highly corrosion-resistant film will not usually be formed. No improvement in performance is observed for treatment times in excess of 60 seconds, but the cost is increased. Accordingly, the preferable treatment time will fall in the range from 2 to 60 seconds.

The practice of the invention and the superior performance of surface-treatment liquid composition according to the present invention may be further appreciated from the following working and comparison examples.

EXAMPLES

General Methods and Criteria for the Examples

The corrosion resistance of treated tin plated cans was evaluated using the iron exposure value ("IEV"), which was measured in accordance with the teaching of U.S. Pat. No. 4,332,646. The corrosion resistance is better at lower IEV values, and a score below 150 is generally regarded as excellent. The corrosion resistance of aluminum DI cans was evaluated based on the resistance to blackening by boiling water. A treated aluminum DI can was immersed for 30 minutes in boiling tap water, and the degree of discoloration (blackening) was visually evaluated in order to determine the resistance to blackening by boiling water. The following scale was used to score the resistance to blackening by boiling water: no blackening= ++, blackening of part of the surface=+, blackening of the entire surface=x.

The paint adhesiveness was evaluated based on the peel strength as follows: The surface of the treated can was coated with an epoxy/urea can paint to a film thickness of 5 to 7 micrometers; this was baked at 215° C. for 4 minutes; the can was then cut into a 5×150 mm strip; a test specimen was prepared by hot-press adhesion with polyamide film; and this was peeled by the 180° peel test method. Accordingly, the paint adhesiveness improves as the peel strength increases, and values in excess of 1.5 kilograms of force per 5 millimeters of width (hereinafter "kgf/5 mm-width") on tin plate or in excess of 4.0 kgf/5 mm-width on aluminum are generally regarded as excellent.

The slideability was evaluated by measuring the static friction coefficient of the exterior surface of the can. Thus, the slideability improves as the static friction co-efficient declines, and values below 1.0 are generally regarded as excellent.

Tin-plated DI cans were prepared by drawing and ironing tin-plated steel sheet. They were cleaned with a 1% hot aqueous solution of a weakly alkaline degreaser (FINE CLEANER TM 4361A, registered brand name of Nihon Parkerizing Company, Limited), then sprayed with a surface-treatment liquid composition according to the invention as described below for each specific example.

Aluminum DI cans were prepared by drawing and ironing aluminum alloy (A3004) sheet. They were cleaned with a 3 % hot aqueous solution of an acidic degreaser (PARCLEAN TM 400, commercially available from Nihon Parkerizing Company, Ltd.), then sprayed a with surface-treatment liquid composition according to the invention as described below for each specific example.

EXAMPLE 1

A tin-plated DI can was cleaned as described above, then sprayed with surface-treatment liquid composition 1 as described below, heated to 60° C., for 30 seconds, then washed with tap water, sprayed with de-ionized water (with a specific resistance of at least 3,000,000 ohm·cm) for 10 seconds, and, finally, dried in a hot air-drying oven at 180° C. for 3 minutes.

Surface-treatment liquid composition 1

75% phosphoric acid ($H_3PO_4$): 10.0 g/L ($PO_4^{3-}$: 7.2 g/L)

sodium pyrophosphate ($Na_4P_2O_7.10H_2O$) 1.0 g/L ($P_2O_7^{4-}$: 0.4 g/L)

resin solids: 2.0 g/L of water-soluble resin 1, in which n in the general formula given above for this resin averaged 40, half of the total of the X's and Y's in the formula were Z, and Z was —$CH_2N(CH_3)CH_2CH_2OH$ pH=4.0 (adjusted with sodium hydroxide)

Water-soluble resin 1 was synthesized as follows. CELLOSOLVE TM solvent in an amount of 100 grams (hereinafter "g") was introduced into a 1,000 milliliter ("mL") reaction flask equipped with a condenser, nitrogen inlet tube, overhead stirrer, and thermometer, and 60 g of poly{4-vinylphenol} with a molecular weight of 5,000 was added and dissolved. Then 40 g of 2-methylaminoethanol and 100 g of deionized water were added, and this was reacted by heating to 50° C. Then 40 g of 37% aqueous formaldehyde solution was added over 1 hour, followed by stirring at 50° C. for 2 hours and by stirring for an additional 3 hours at 80° C. The reaction product was cooled, 15 g of 85% orthophosphoric acid was added, and 700 g of deionized water was also added. The resin was then precipitated by the addition of 10% aqueous sodium hydroxide solution until the pH of the reaction solution reached 8 to 9. The precipitated resin was filtered off, washed with water, and dried.

EXAMPLE 2

Tin-plated DI can was cleaned using the same conditions as in Example 1 and was then treated with a 30 second spray of surface-treatment liquid composition 2, heated to 60° C. This treatment was followed with a water wash and drying using the same conditions as in Example 1.

Surface-treatment liquid composition 2

75% phosphoric acid ($H_3PO_4$): 10.0 g/L ($PO_4^{3-}$: 7.2 g/L)

sodium pyrophosphate ($Na_4P_2O_710H_2O$): 1.0 g/L ($P_2O_7^{4-}$: 0.4 g/L)

resin solids: 0.4 g/L of water soluble resin 1 as in Example 1 pH=5.0 (adjusted with sodium carbonate)

EXAMPLE 3

Tin-plated DI can was cleaned using the same conditions as in Example 1 and was then treated with a 30 second spray of surface-treatment liquid composition 3 heated to 60 ° C. This treatment was followed with a water wash and drying using the same conditions as in Example 1.

Surface-treatment liquid composition 3

75% phosphoric acid ($H_3PO_4$): 20.0 g/L ($PO_4^{3-}$: 14.4 g/L)

sodium pyrophosphate ($Na_4P_2O_7.10H_2O$): 1.0 g/L ($P_2O_7^{4-}$: 0.4 g/L)

resin solids: 8.0 g/L of water-soluble resin 1 as in Example 1 pH=4.0 (adjusted with sodium hydroxide)

EXAMPLE 4

Tin-plated DI can was cleaned using the same conditions as in Example 1 and was then treated with a 30 second spray of surface-treatment liquid composition 4 heated to 60° C. This treatment was followed with a water wash and drying using the same conditions as in Example 1.

Surface-treatment liquid composition 4

75% phosphoric acid ($H_3PO_4$): 15.0 g/L ($PO_4^{3-}$: 10.9 g/L)

sodium pyrophosphate ($Na_4P_2O_7.10H_2O$): 2.5 g/L ($P_2O_7^{4-}$: 1.0 g/L)

resin solids: 4.0 g/L of water-soluble resin 1 as in Example 1 pH=3.0 (adjusted with sodium carbonate)

EXAMPLES 5

Tin-plated DI can was cleaned using the same conditions as in Example 1 and was then treated with a 30 second spray of surface-treatment liquid composition 5 heated to 60° C. This treatment was followed with a water wash and drying using the same conditions as in Example 1.

Surface-treatment liquid composition 5

75% phosphoric acid ($H_3PO_4$): 30.0 g/L ($PO_4^{3-}$: 21.6 g/L)

sodium tripolyphosphate ($Na_5P_3O_{10}$): 0.6 g/L ($P_3O_{10}^{5-}$: 0.4 g/L)

resin solids: 2.0 g/L of water-soluble resin 1 as in Example 1 pH=3.5 (adjusted with sodium hydroxide)

EXAMPLE 6

Tin-plated DI can was cleaned using the same conditions as in Example 1 and was then treated with a 30 second spray of surface-treatment liquid composition 6 heated to 60° C. This treatment was followed with a water wash and drying using the same conditions as in Example 1.

Surface-treatment liquid composition 6

75% phosphoric acid ($H_3PO_4$): 10.0 g/L ($PO_4^{3-}$: 7.2 g/L)

sodium pyrophosphate ($Na_4P_2O_7.10H_2O$): 1.0 g/L ($P_2O_7^{4-}$: 0.4 g/L)

resin solids: 2.0 g/L of water-soluble resin 2 pH=4.0 (adjusted with sodium hydroxide)

Water soluble resin 2 was made in the same way as water soluble resin 1, except that the quantities of material used were 60 g of poly-4-vinylphenol, 20 g of 2-methylaminoethanol, and 40 g 37% formaldehyde solution. As a result of these changes, n in the general formula given for the resin had an average value of about 40 as before, but only about 25% of the total of all X's and Y's in the formula were of type Z.

EXAMPLE 7

Tin-plated DI can was cleaned using the same conditions as in Example 1 and was then treated with a 30 second spray of surface-treatment liquid composition 7 heated to 60° C. This treatment was followed with a water wash and drying using the same .conditions as in Example 1.

Surface-treatment liquid composition 7

75% phosphoric acid ($H_3PO_4$): 10.0 g/L ($PO_4^{3-}$: 7.2 g/L)

sodium pyrophosphate ($Na_4P_2O_7.10H_2O$): 1.0 g/L ($P_2O_7^{4-}$: 0.4 g/L)

resin solids: 2.0 g/L of water-soluble resin 3 pH=6.0 (adjusted with sodium hydroxide)

Water soluble resin 3 was made in the same way as water soluble resin 1, except that 24 g of dimethylamine were substituted for the 40 g of 2-methylaminoethanol used in making water soluble resin 1. As a result of this change the Z groups in water soluble resin 3 had the formula $—CH_2N(CH_3)_2$, but the average value of n in the general formula remained about 40 and about 50% of the total X's and Y's in the general formula were of type Z.

Comparison Example 1

Tin-plated DI can was cleaned using the same conditions as in Example 1 and was then treated with a 30 second spray of surface-treatment liquid composition 8 heated to 60° C. This treatment was followed with a water wash and drying using the same conditions as in Example 1.

Surface-treatment liquid composition 8

75% phosphoric acid ($H_3PO_4$): 10.0 g/L ($PO_4^{3-}$: 7.2 g/L)

resin solids: 2.0 g/L of the same water-soluble resin as in Example 1.

pH=4.0 (adjusted with sodium carbonate)

Comparison Example 2

Tin-plated DI can was cleaned using the same conditions as in Example 1 and was then treated with a 30 second spray of surface-treatment liquid composition 9 heated to 60° C. This treatment was followed with a water wash and drying using the same conditions as in Example 1.

Surface-treatment liquid composition 9

75% phosphoric acid ($H_3PO_4$): 1.0 g/L ($PO_4^{3-}$: 0.72 g/L)

resin solids: 2.0 g/L of the same water-soluble resin as in Example 1 pH=7.0 (adjusted with sodium hydroxide)

Comparison Example 3

Tin-plated DI can was cleaned using the same conditions as in Example 1 and was then treated with a 30 second spray of surface-treatment liquid composition 10 heated to 60 ° C. This treatment was followed with a water wash and drying using the same conditions as in Example 1.

Surface-treatment liquid composition 10

75% phosphoric acid ($H_3PO_4$): 10.0 g/L ($PO_4^{3-}$: 7.2 g/L)

sodium pyrophosphate ($Na_4P_2O_7.10H_2O$): 1.0 g/L ($P_2O_7^{4-}$: 0.4 g/L)

resin solids: 0.05 g/L of the same water-soluble resin as in Example 1 pH=4.0 (adjusted with sodium carbonate)

Comparison Example 4

Tin-plated DI can was cleaned using the same conditions as in Example 1 and was then treated with a 30 second spray of surface-treatment liquid composition 11 heated to 60° C. This treatment was followed with a water wash and drying using the same conditions as in Example 1.

Surface-treatment liquid composition 11

75% phosphoric acid ($H_3PO_4$): 1.0 g/L ($PO_4^{3-}$: 0.72 g/L)

sodium pyrophosphate ($Na_4P_2O_7$. $10H_2O$): 1.0 g/L ($P_2O_7^{4-}$: 0.4 g/L)

resin solids: 2.0 g/L of water-soluble resin 4 pH=4.0 (adjusted with sodium hydroxide)

Water-soluble resin 4 had the chemical formula:

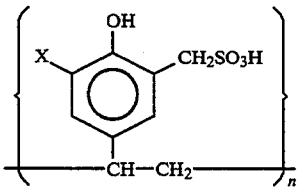

The average value of n was about 40.

Water-soluble resin 4 was synthesized as follows: 50 g of poly{4-vinylphenol} (molecular weight=about 5,000) was placed in a 1,000 mL reaction flask equipped with a condenser, nitrogen inlet tube, overhead stirrer, and thermometer, and 500 g of 1,4-dioxane was added for dissolution. An amount of 80 g of liquid sulfur trioxide ($SO_3$) was added over a time of 1 hour while the mixture was maintained at around 10° C. This was followed by heating to 80° C. and reaction for 4 hours while stirring. Neutralization was carried out with 10% sodium hydroxide solution and the solvent was distilled off.

The results of the experiments and comparison experiments on tin plated DI cans are reported in Table 1, and they confirm that the conditions according to the present invention afford an excellent corrosion resistance, adhesiveness, and slideability, with all these factors being superior to those obtained in the comparison examples.

TABLE 1

| | Test Results | | |
|---|---|---|---|
| | IEV | Peel Strength, kgf/5 mm-width | Frictional Coefficient |
| Example 1 | 40 | 2.0 | 0.8 |
| Example 2 | 40 | 2.0 | 0.8 |
| Example 3 | 50 | 2.0 | 0.8 |
| Example 4 | 40 | 2.0 | 0.8 |
| Example 5 | 40 | 2.0 | 0.8 |
| Example 6 | 60 | 2.0 | 0.8 |
| Example 7 | 40 | 2.0 | 0.8 |
| Comparison Example 1 | 250 | 1.5 | 1.0 |
| Comparison Example 2 | 950 | 1.3 | 1.0 |
| Comparison Example 3 | 500 | 1.5 | 1.0 |
| Comparison Example 4 | 750 | 1.3 | 1.0 |

EXAMPLE 8

An aluminum DI can was cleaned as described above, then sprayed with surface-treatment liquid composition 12 as described below, heated to 60° C., for 30 seconds, then washed with tap water, sprayed with de-ionized water (with a specific resistance of at least 3,000,000 ohm·cm) for 10 seconds, and, finally, dried in a hot air-drying oven at 180° C. for 3 minutes.

Surface-treatment liquid composition 12

75% phosphoric acid ($H_3PO_4$): 10.0 g/L ($PO_4^{3-}$: 7.2 g/L)

sodium pyrophosphate ($Na_3P_2O_7.10H_2O$): 3.0 g/L ($P_2O_7^{4-}$: 1.2 g/L)

resin solids: 2.0 g/L of water-soluble resin 1, in which n in the general formula given above for this resin averaged 40, half of the total of the X's and Y's in the formula were Z, and Z was $—CH_2N(CH_3)CH_2CH_2OH$ pH=4.0 (adjusted with sodium hydroxide)

Water-soluble resin 1 was the same as in Example 1

EXAMPLE 9

An aluminum DI can was cleaned using the same conditions as in Example 8 and was then treated with a 30 second spray of surface-treatment liquid composition 13, heated to 60° C. This treatment was followed with a water wash and drying using the same conditions as in Example 1.

Surface-treatment liquid composition 13

75% phosphoric acid ($H_3PO_4$): 10.0 g/L ($PO_4^{3-}$: 7.2 g/L)

sodium pyrophosphate ($Na_4P_2O_7.10H_2O$): 3.0 g/L ($P_2O_7^{4-}$: 1.2 g/L)

resin solids: 0.4 g/L of water soluble resin 1 as in Example 1 pH=5.0 (adjusted with sodium carbonate) EXAMPLE 10

An aluminum DI can was cleaned using the same conditions as in Example 8 and was then treated with a 30 second spray of surface-treatment liquid composition 14 heated to 60° C. This treatment was followed with a water wash and drying using the same conditions as in Example 1.

Surface-treatment liquid composition 14

75% phosphoric acid ($H_3PO_4$): 20.0 g/L ($PO_4^{3-}$: 14.4 g/L)

sodium pyrophosphate ($Na_4P_2O_7.10H_2O$): 6.0 g/L ($P_2O_7^{4-}$: 2.4 g/L)

resin solids: 8.0 g/L of water-soluble resin 1 as in Example 1 pH=6.0 (adjusted with sodium hydroxide) EXAMPLE 11

An aluminum DI can was cleaned using the same conditions as in Example 8 and was then treated with a 30 second spray of surface-treatment liquid composition 15 heated to 60° C. This treatment was followed with a water wash and drying using the same conditions as in Example 1.

Surface-treatment liquid composition 15

75% phosphoric acid ($H_3PO_4$): 15.0 g/L ($PO_4^{3-}$: 10.9 g/L)

sodium pyrophosphate ($Na_4P_2O_7.10H_2O$): 5.0 g/L ($P_2O_7^{4-}$: 2.0 g/L)

resin solids: 4.0 g/L of water-soluble resin 1 as in

Example 12 pH=3.0 (adjusted with sodium carbonate) Example 12

An aluminum DI can was cleaned using the same conditions as in Example 8 and was then treated with a 30 second spray of surface-treatment liquid composition 16 heated to 60° C. This treatment was followed with a water wash and drying using the same conditions as in Example 1.

Surface-treatment liquid composition 16

75% phosphoric acid ($H_3PO_4$): 30.0 g/L ($PO_4^{3-}$: 21.6 g/L)

sodium tripolyphosphate ($Na_5P_3O_{10}$): 1.2 g/L ($P_3O_{10}^{5-}$: 0.8 g/L)

resin solids: 2.0 g/L of water-soluble resin 1 as in Example 1 pH=3.5 (adjusted with sodium hydroxide)

EXAMPLE 13

An aluminum DI can was cleaned using the same conditions as in Example 8 and was then treated with a 30 second spray of surface-treatment liquid composition 17 heated to 60 ° C. This treatment was followed with a water wash and drying using the same conditions as in Example 1.

Surface-treatment liquid composition 17

75% phosphoric acid ($H_3PO_4$): 10.0 g/L ($PO_4^{3-}$: 7.2 g/L)

sodium pyrophosphate ($Na_4P_2O_7.10H_2O$): 3.0 g/L ($P_2O_7^{4-}$: 1.2 g/L)

resin solids: 2.0 g/L of water-soluble resin 2 pH=4.0 (adjusted with sodium hydroxide)

Water soluble resin 2 was made in the same way as in Example 6.

EXAMPLE 14

An aluminum DI can was cleaned using the same conditions as in Example 8 and was then treated with a 30 second spray of surface-treatment liquid composition 18 heated to 60° C. This treatment was followed with a water wash and drying using the same conditions as in Example 1 .

Surface-treatment liquid composition 18

75% phosphoric acid ($H_3PO_4$): 10.0 g/L ($PO_4^{3-}$: 7.2 g/L)

sodium pyrophosphate ($Na_4P_2O_7.10H_2O$): 3.0 g/L ($P_2O_7^{4-}$: 1.2 g/L)

resin solids: 2.0 g/L of water-soluble resin 3 pH=4.0 (adjusted with sodium hydroxide)

Water soluble resin 3 was made in the same way as in Example 7.

Comparison Example 5

An aluminum DI can was cleaned using the same conditions as in Example 8 and was then treated with a 30 second spray of surface-treatment liquid composition 19 heated to 60 ° C. This treatment was followed with a water wash and drying using the same conditions as in Example 1.

Surface-treatment liquid composition 19

75% phosphoric acid ($H_3PO_4$): 10.0 g/L ($PO_4^{3-}$: 7.2 g/L)

resin solids: 2.0 g/L of the same water-soluble resin as in Example 1 .

pH=4.0 (adjusted with sodium carbonate)

Comparison Example 6

An aluminum DI can was cleaned using the same conditions as in Example 8 and was then treated with a 30 second spray of surface-treatment liquid composition 20 heated to 60° C. This treatment was followed with a water wash and drying using the same conditions as in Example 1.

Surface-treatment liquid composition 20

75% phosphoric acid ($H_3PO_4$): 1.0 g/L ($PO_4^{3-}$: 0.72 g/L)

resin solids: 2.0 g/L of the same water-soluble resin as in Example 1 pH=7.0 (adjusted with sodium hydroxide)

Comparison Example 7

An aluminum DI can was cleaned using the same conditions as in Example 8 and was then treated with a 30 second spray of surface-treatment liquid composition 21 heated to 60° C. This treatment was followed with a water wash and drying using the same conditions as in Example 1.

Surface-treatment liquid composition 21

75% phosphoric acid ($H_3PO_4$): 10.0 g/L ($PO_4^{3-}$: 7.2 g/L)

sodium pyrophosphate ($Na_4P_2O_7.10H_2O$): 1.0 g/L ($P_2O_7^{4-}$: 0.4 g/L)

resin solids: 0.05 g/L of the same water-soluble resin as in Example 1 pH=4.0 (adjusted with sodium carbonate)

Comparison Example 8

An aluminum DI can was cleaned using the same conditions as in Example 8 and was then treated with a 30 second spray of surface-treatment liquid composition 22 heated to 60° C. This treatment was followed with a water wash and drying using the same conditions as in Example 1.

Surface-treatment liquid composition 22

75% phosphoric acid ($H_3PO_4$): 1.0 g/L ($PO_4^{3-}$: 0.72 g/L)

sodium pyrophosphate ($Na_4P_2O_7.10H_2O$): 1.0 g/L ($P_2O_7^{4-}$: 0.4 g/L)

resin solids: 2.0 g/L of water-soluble resin 4 pH=4.0 (adjusted with sodium hydroxide)

Water-soluble resin 4 was the same as for Comparison Example 4 above.

Comparison Example 5

An aluminum DI can was cleaned under the same conditions as in Example 8 and was then treated with a 30 second spray of a 2% aqueous solution (heated to 50° C.) of a commercial non-chromate agent (PARCOAT TM K 3761, from Nihon Parkerizing Company, Ltd.). This-treatment was followed by a water wash and drying under the same conditions as in Example 1.

The results of these examples and comparison examples on aluminum substrates are shown in Table 2.

TABLE 2

| | Test Results on Aluminum DI Cans | | |
|---|---|---|---|
| | Resistance to Blackening by Boiling Water | Peel Strength in kgf/5 mm-width | Frictional Coefficient |
| Example 8 | ++ | 4.0 | 1.0 |
| Example 9 | ++ | 4.0 | 1.0 |
| Example 10 | ++ | 4.0 | 1.0 |
| Example 11 | ++ | 4.0 | 1.0 |
| Example 12 | ++ | 4.0 | 1.0 |
| Example 13 | ++ | 4.0 | 1.0 |
| Example 14 | ++ | 4.0 | 0.9 |
| Comparison Example 5 | + | 2.0 | 1.2 |
| Comparison Example 6 | x | 1.5 | 1.3 |
| Comparison Example 7 | x | 2.0 | 1.3 |
| Comparison EXample 8 | x | 1.5 | 1.3 |
| Comparison Example 9 | ++ | 4.0 | 1.3 |

Benefits of the Invention

Treatment of tin-plated or aluminum DI cans using a surface-treatment liquid composition with the composition given above imparts. an excellent corrosion resistance and painting or printing. In addition, it also produces a film which has the excellent slideability necessary for smooth conveyor transport of the can.

Moreover, when the condensed phosphate ions comprises at least one selection from pyrophosphate ions, tripolyphosphate ions, and tetrapolyphosphate ions and when:

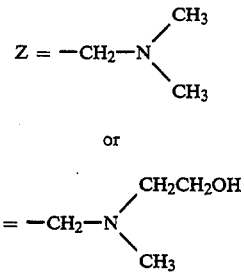

a film is produced which evidences an even greater improvement in the corrosion resistance, paint adhesiveness, and slideability. The treatment solution according to this invention is substantially free from chromium and fluoride and therefore has relatively low pollution potential.

The invention claimed is:

1. An aqueous liquid composition for treating the surface of tin-plated steel or of aluminum or aluminum alloys, said composition having a pH in the range from 2.0 to 6.5 and consisting essentially of water and:

(A) from 1 to 30 g/L of phosphate ions, (B) from 0.1 to 10 g/L of condensed phosphate ions, and (C) from 0.1 to 20 g/L as solids of a water-soluble resin component selected from the group of resins, including mixtures of resins, having the general chemical formula:

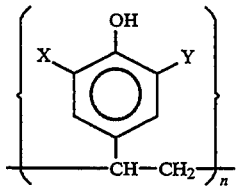

wherein n is an integer with the range from 10 to 80 inclusive; each of X and Y is independently selected from hydrogen or a group "Z" with the formula given below, with the proviso that at least 15% of the total of all of the X and Y groups in this component of the composition are Z and

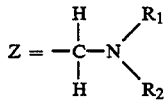

wherein each of $R_1$ and $R_2$ in each of the Z groups in the formula independently is selected from the group consisting of alkyl groups containing from 1 to 10 carbon atoms per group and hydroxyalkyl groups containing from 1 to 10 carbon atoms per group, and, optionally, (D) a chelating agent.

2. A liquid composition according to claim 1, wherein component (B) is selected from the group consisting or pyrophosphate ions, tripolyphosphate ions, tetrapolyphosphate ions, and mixtures thereof.

3. A liquid composition according to claim 2, wherein, in the general chemical formula for the water soluble resin component,

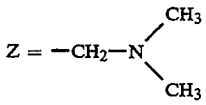

or

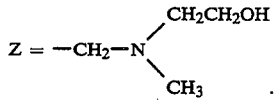

4. A liquid composition according to claim 1, wherein, in the general chemical formula for the water soluble resin component,

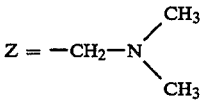

or

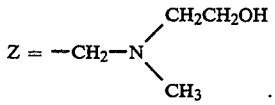

5. A liquid composition according to claim 4, comprising from 5 to 15 g/L of component (A).

6. A process for treating a drawn and ironed tin-plated steel, aluminum, or aluminum alloy metal container comprising contacting said container with an aqueous liquid composition for a period of time sufficient to form on the surface of the metal container a conversion coating layer that will increase the corrosion resistance of the container after subsequent painting or printing, wherein the aqueous liquid composition has a pH in the range from 2.0 to 6.5, does not contain chromium or fluorine, and consists essentially of water and:

(A) from 1 to 30 g/L of phosphate ions, (B) from 0.1 to 5 g/L of condensed phosphate ions if used for tin-plated steel or from 0.1 to 10 g/L or condensed phosphate ions if used for aluminum or aluminum alloy, and (C) from 0.1 to 20 g/L as solids of a water-soluble resin component selected from the group of resins, including mixtures of resins, having the general chemical formula:

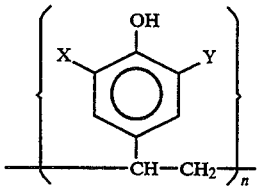

wherein n is an integer within the range from 10 to 80 inclusive; each of X and Y is independently selected from hydrogen or a group "Z" with the formula given below, except that at least 15% of the total of all of the X and Y groups in this component of the composition arc Z rather than hydrogen; and

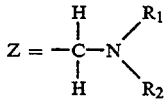

wherein each of $R_1$ and $R_2$ in each of the Z groups in the formula independently is selected from the group consisting of alkyl groups containing from 1 to 10 carbon atoms per group and hydroxyalkyl groups containing from 1 to 10 carbon atoms per group, and, optionally, (D) a chelating agent.

7. A process according to claim 6, wherein the time of contact is within the range from 2 to 60 seconds, contact is by spraying, and the temperature of the liquid composition during contact is between 20° and 80° C.

8. A process according to claim 7, comprising additional steps of first degreasing and then tap water washing the container surface before contacting with the aqueous liquid composition and, in order, tap water washing, washing with deionized water, and drying after contact with the aqueous liquid.

9. A liquid composition according to claim 3, comprising from 5 to 15 g/L of component (A).

10. A liquid composition according to claim 2, comprising from 5 to 15 g/L or component (A).

11. A liquid composition according to claim 1, comprising from 5 to 15 g/L of component (A).

12. A process according to claim 8, wherein the aqueous liquid composition contains from 4.0 to 1 g/L of component (B) when used on tin-plated steel and contains from 1.0 to 4.0 g/L of component (B) when used on aluminum or aluminum alloy.

13. A process according to claim 12, wherein the aqueous liquid composition contains from 5 to 15 g/L of component (A).

14. A process according to claim 13, wherein, in the aqueous liquid composition, in the general chemical formula for the water soluble resin component.

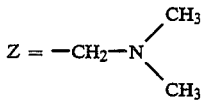

or

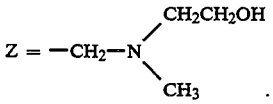

15. A process according to claim 7, wherein the aqueous liquid composition contains from 0.4 to 1 g/L of component (B) when used on tin-plated steel and contains from 1.0 to 4.0 g/L of component (B) when used on aluminum or aluminum alloy.

16. A process according to claim 15, wherein the aqueous liquid composition contains from 5 to 15 g/L of component (A).

17. A process according to claim 16, wherein, in the aqueous liquid composition, in the general chemical formula for the water soluble resin component,

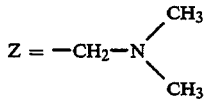

or

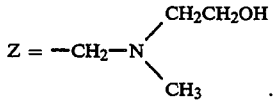

18. A process according to claim 6, wherein the aqueous liquid composition contains from 0.4 to 1 g/L of component (B) when used on tin-plated steel and contains from 1.0 to 4.0 g/L of component (B) when used on aluminum or aluminum alloy.

19. A process according to claim 18, wherein the aqueous liquid composition contains from 5 to 15 g/L of component (A).

20. A process according to claim 18, wherein, in the aqueous liquid composition, in the general chemical formula for the water soluble resin component,

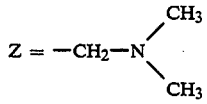

or

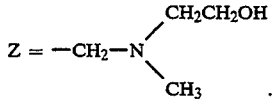

* * * * *